US007626509B2

(12) United States Patent
Dean

(10) Patent No.: US 7,626,509 B2
(45) Date of Patent: Dec. 1, 2009

(54) SOLAR LIGHT FOR HOME SECURITY SIGNS

(76) Inventor: Lance Dean, 629 Deforest Rd., Coppell, TX (US) 75019

( * ) Notice: Subject to any disclaimer, the term of this patent is extended or adjusted under 35 U.S.C. 154(b) by 258 days.

(21) Appl. No.: 11/714,293

(22) Filed: Mar. 5, 2007

(65) Prior Publication Data

US 2008/0218088 A1 Sep. 11, 2008

(51) Int. Cl.
*G08B 3/00* (2006.01)

(52) U.S. Cl. ..... 340/691.8; 340/693.1; 340/693.5; 340/908; 340/944; 340/473; 315/154; 315/156; 315/159; 315/183; 362/183; 362/276; 362/394; 362/395

(58) Field of Classification Search ..... 340/691.8, 340/693.1, 693.5, 908, 944, 473, 691.1; 315/156, 315/159, 154, 183; 362/183, 276, 394, 395
See application file for complete search history.

(56) References Cited

U.S. PATENT DOCUMENTS

| | | | | | |
|---|---|---|---|---|---|
| 4,486,820 | A * | 12/1984 | Baba et al. | ..... | 362/183 |
| 4,835,664 | A * | 5/1989 | Wen | ..... | 362/183 |
| 5,211,470 | A * | 5/1993 | Frost et al. | ..... | 362/183 |
| 5,221,891 | A * | 6/1993 | Janda et al. | ..... | 323/350 |
| 2003/0053308 | A1 * | 3/2003 | Cathel | ..... | 362/154 |
| 2004/0113903 | A1 * | 6/2004 | Mikami et al. | ..... | 345/204 |

* cited by examiner

*Primary Examiner*—Tai T Nguyen
(74) *Attorney, Agent, or Firm*—Ober / Kaler; Royal W. Craig

(57) ABSTRACT

An easily deployable miniature, LED light unit specifically for home security yard signs that is rechargeable by means of a solar cell array having a light sensor which automatically activates the light at dusk and deactivates it at dawn. The solar light unit is contained in a unique compact molded housing that positions the components and also includes an integral clamp-mount specifically for slide-on mounting to the stakes of typical home security signs.

13 Claims, 6 Drawing Sheets

SOLAR LIGHT FOR HOME SECURITY SIGNS

BACKGROUND OF THE INVENTION (1) Field of the Invention

The present invention relates generally to solar powered lighting devices and more particularly pertains to a miniature, LED light unit that is rechargeable by means of a solar cell array having a light sensor which automatically activates the light at dusk and deactivates it at dawn. The solar light unit is contained in a compact molded housing that positions the components and also includes an integral clamp-mount specifically for mounting to the stakes of typical home security signs.

(2) Description of Prior Art

Consumers and business owners know that for a very small investment of time and money they can make their homes and businesses much more secure and reduce the risk of theft simply by placing a home security yard sign outside on the front lawn, usual near the mail box. These signs are simple and small placards mounted on aluminum ground-stakes and bearing a warning that the premises are protected by a particular security system. Burglars are looking for an easy target and will normally pass up a home or business which advertises that an alarm system is present. Consequently, these signs are intentionally bright and easy to read, and deter theft even when the premises are not really equipped with an alarm system. However, between 30-40% of burglaries occur at night when security signs, even if present, are not visible. Currently there are no convenient lighting solutions for home security signs inasmuch as they are usually very remotely located from any electrical outlets.

The use of solar powered lighting devices is well known in the prior art and offers a solution in this case.

Known prior art solar powered lighting devices include U.S. Pat. No. 4,782,432; U.S. Pat. No. 4,823,241; U.S. Pat. No. 5,211,470; and U.S. Pat. No. 5,217,296.

Unfortunately, while these devices fulfill their respective, particular objectives and requirements, the aforementioned patents do not disclose lighting solution that is miniaturized and housed in a self-clamping housing for unobtrusive mounting on the slender stake of the relatively small home security signs. There remains a need for a solar light unit contained in a compact molded housing that positions the components and also includes an integral clamp-mount specifically for mounting to the stakes of typical home security signs. Such a device should be inexpensive, durable, lightweight, compact, portable and efficient. Since the device must brightly illuminate a very small signage area for long twelve hour nighttime periods, yet do so with efficiency, a solar-charging miniature LED unit is most appropriate that remains off while charging during the day, and illuminates at night, all night.

SUMMARY OF THE INVENTION

It is therefore, an object of this invention to provide a lighting solution specifically for home security yard signs that is miniaturized and housed in a self-clamping housing for unobtrusive mounting on the slender stake of a conventional home security sign.

It is another object to prove a lighting solution as described above contained in a compact molded hand-held housing that positions the components and also includes an integral clamp-mount specifically for mounting to the stakes of typical home security signs.

It is still another object to provide a lighting device as described above that is inexpensive, weather-proof, durable, lightweight, compact, portable and efficient.

It is still another object to provide a lighting solution for home security yard signs that is capable of brightly illuminating a very small signage area for long twelve hour nighttime periods, that remains off while charging during the day, and illuminates at night, all night.

According to the present invention, the above described and other objects are accomplished by providing a

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is an easily deployable miniature, LED light unit specifically for home security yard signs that is rechargeable by means of a solar cell array having a light sensor which automatically activates the light at dusk and deactivates it at dawn. The solar light unit is contained in a unique compact molded housing that positions the components and also includes an integral clamp-mount specifically for slide-on mounting to the stakes of typical home security signs.

Figure 1:
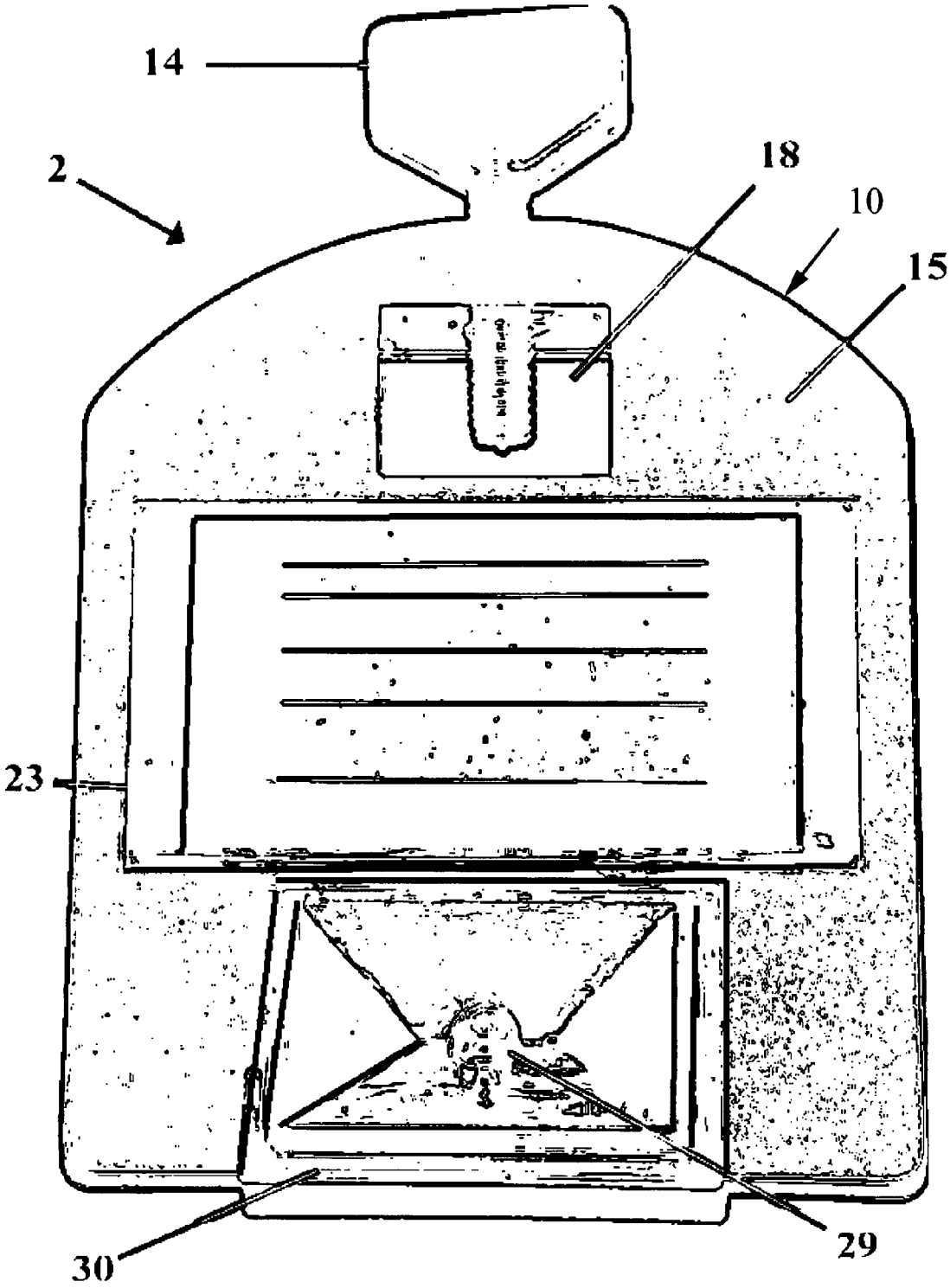
FIG. 1 is a top view of the solar light unit for home security signs 2 according to a preferred embodiment of the invention.

FIG. 1 is a top view of the solar light unit for home security signs 2 according to a preferred embodiment of the invention.

The solar light unit 2 generally comprises a shallow fully-enclosed weatherproof housing 10 formed from a molded concave open-faced top section 15 and a mating bottom panel 16 for screw-attachment onto the top section 15.

The housing 10 encloses a rechargeable electrical power source (such as a NiCad or Lithium Ion battery) disposed in the top section 15 and coupled through a push-detent on/off switch to an internal circuit board with a solar charging circuit, light sensor circuit, and LED driver circuit. The light sensor circuit triggers the LED driver to apply power to the LED only at night when there is no ambient light, thereby conserving power. Still, an optional second (backup) battery may be connected in parallel with a primary battery if desired to ensure that the power source has ample charge to power the LED light at night even when there wasn't any sun that day.

The solar charging circuit is connected to a panel mount solar cell 23 and the LED driver circuit is connected to a white LED 29 seated in a reflective assembly 30. Both the panel mount solar cell 23 and LED 29/reflective assembly 30 are panel mounted on the top section 15 and so face upward when the solar light unit 2 is mounted to the stake of a conventional home security sign 2.

Figure 2:
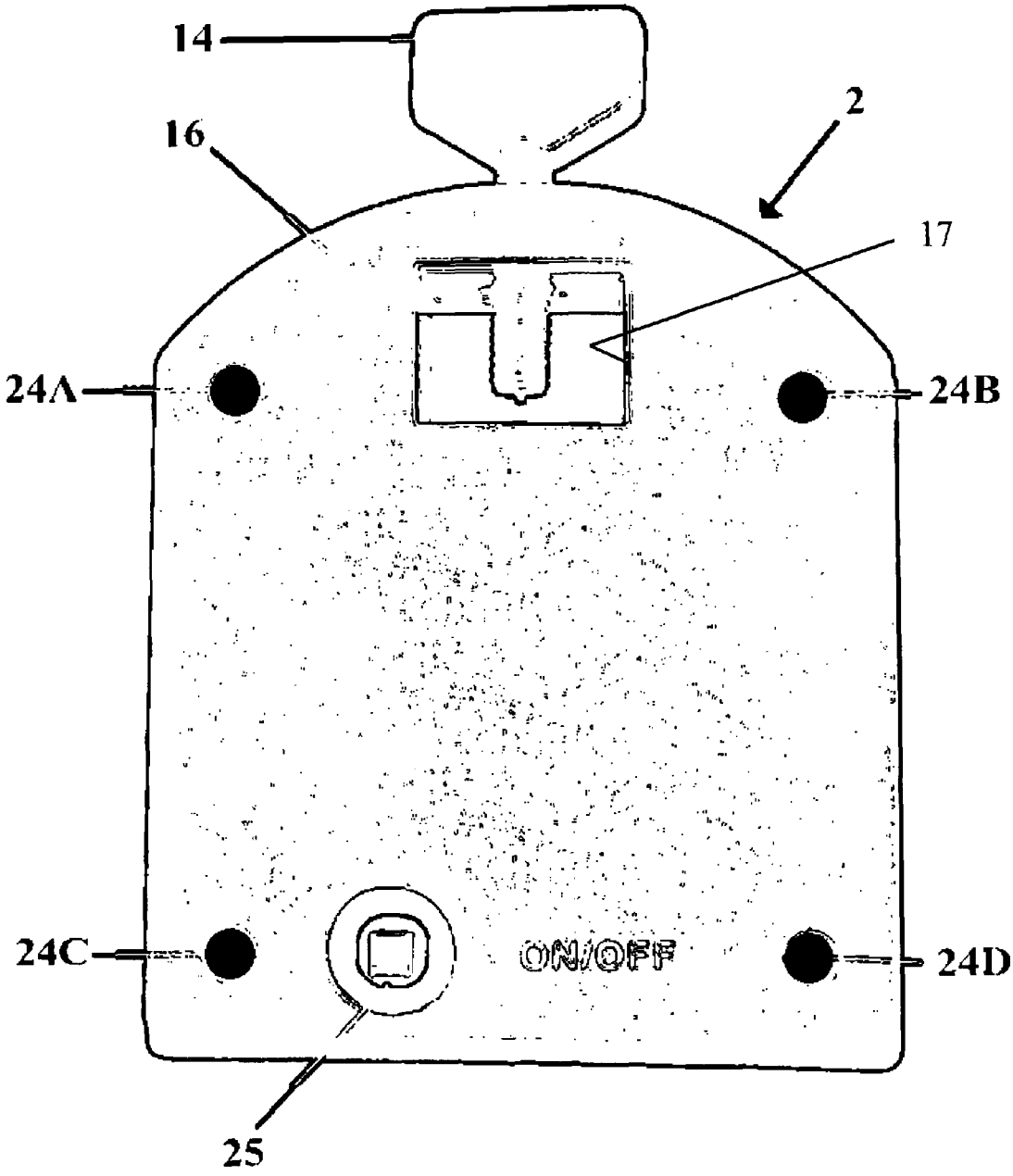
FIG. 2 is a bottom view of the solar powered light unit 2, and the mating bottom panel 16

FIG. 2 is a bottom view of the solar powered light unit 2, and the mating bottom panel 16 which is screw-attached onto the top section 15 by four stainless steel machine screws 24A-D. The push-detent on/off switch 25 is panel mounted on the bottom panel 16 as shown.

The structure and operation of the housing 10 is an important feature of the present invention and so is described in detail with combined reference to FIGS. 1 and 2.

The open-faced top section 15 and mating bottom panel 16 are of the same approximate peripheral dimensions, here about 6 2½" long and 2½" wide so that the entire device 2 can fit in the palm of an adult hand. Both the top section 15 and mating bottom panel 16 are formed with a rectangular aperture 17 defined there through centrally located proximate one end. The aperture 17 generally conforms to the cross-section of the stake of a conventional home security sign and is intended to allow the device 2 to be slidably inserted onto said stake. A plastic thumbscrew 14 is threaded sidelong into the top section 15 and enters the aperture 17 to lock the solar powered light unit 2 in position on the stake.

Figure 4:
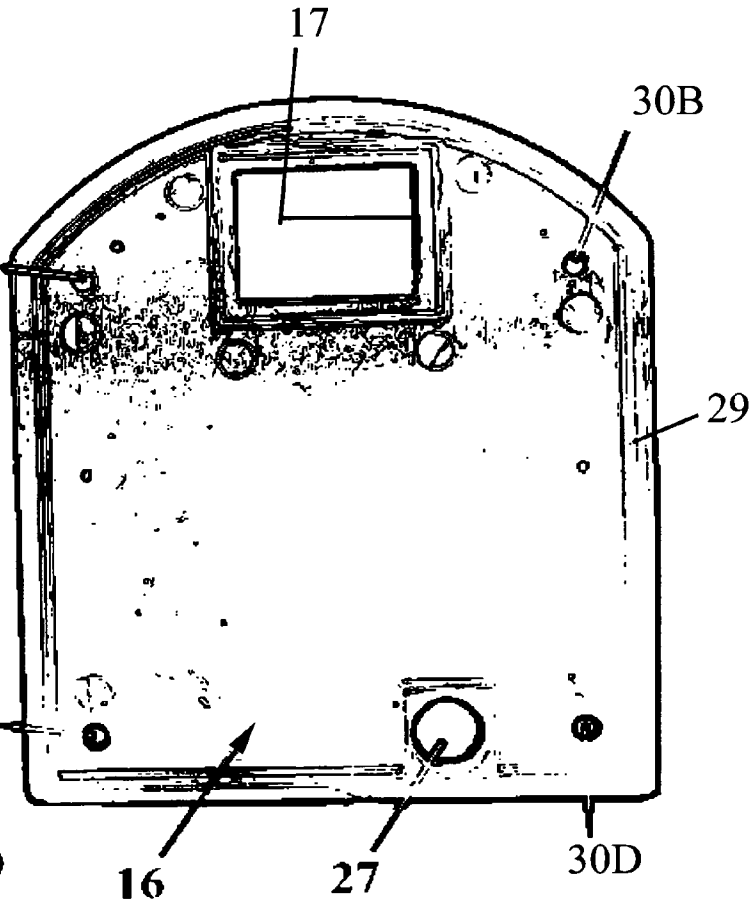
FIG. 3 is an inside view of the open top section 15 of housing 10 and FIG. 4 is an inside view of the bottom panel 16.
Figure 3:
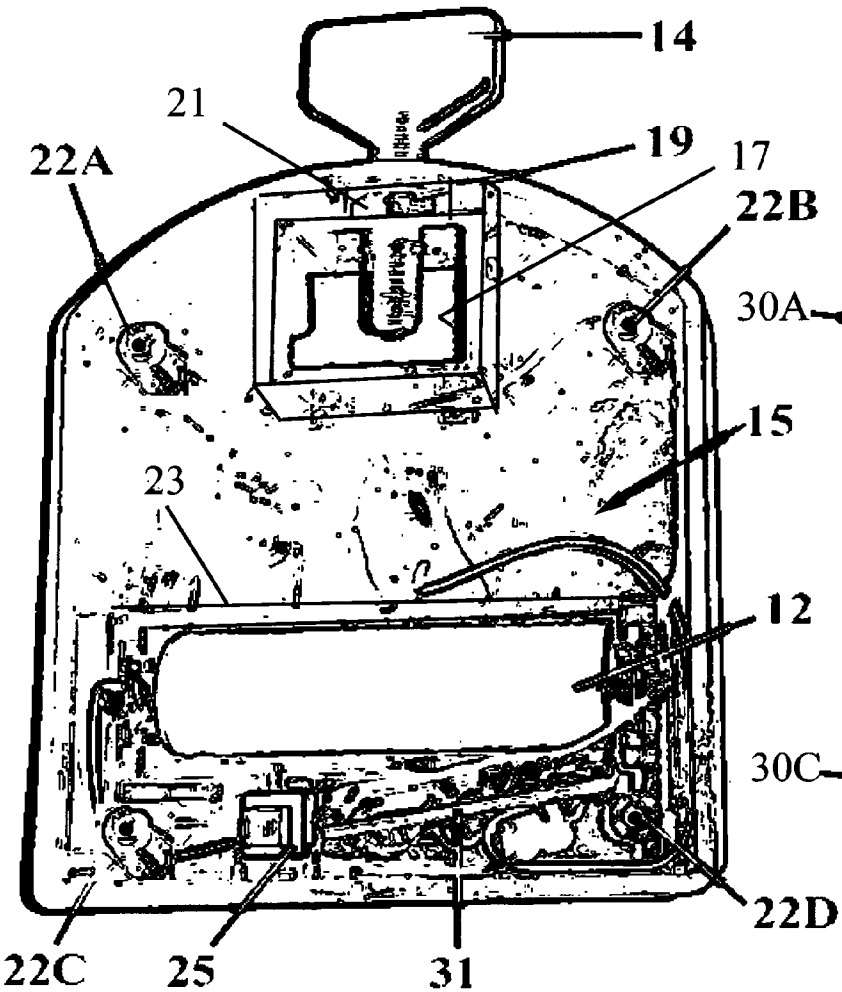

FIG. 3 is an inside view of the open top section 15 of housing 10 and FIG. 4 is an inside view of the bottom panel 16.

The open-faced top section 15 is a molded plastic component formed as a concave enclosure bounded by peripheral sidewalls. The presently preferred shape of top section 15 is substantially rectangular or square with one expanded end formed with an arcuate sidewall. It is into this arcuate sidewall that the plastic thumbscrew 14 is centrally threaded. Again the thumbscrew 14 enters the aperture 17. To reinforce the aperture 17 it is bounded by rectangular sidewalls spaced slightly from those of the top section 15, and note that a metallic wing nut 19 with internal screw threads is seated in the topmost sidewall of aperture 17 to threadably receive the thumbscrew 14. The aperture 17 is substantially square to conform to (but is slightly larger than) the cross-section of the yard security sign stake so that the stake can be inserted orthogonally there through. The preferred shape of the aperture 17 is rectangular and is sized at approximately 0.7" by 0.5" to accommodate the two most commonly-sized security stakes used in the industry. The above-sized aperture will fit both the thin and wider-variety stakes. With the foregoing configuration, the plastic thumbscrew 14 serves as a manually-tightened clamp against the stake to lock the solar powered light unit 2 in position. The smooth arcuate sidewall of the top section 15 in the vicinity of the thumbscrew 14 serves to minimize interference with the fingers as the thumbscrew 14 is manually tightened.

Other features of the top section 15 include four corner-spaced upwardly protruding posts 22A-D with central bores for receiving the machine screws 24A-D entering from the bottom panel 16, and raised rectangular open-faced sidewalls 23 forming a trough for seating the power source (here a singular battery 12).

The bottom panel 16 is likewise substantially rectangular or square with one expanded end formed with an arcuate sidewall (in the case of bottom panel 16 the sidewalls are much less pronounced). The aperture 17 is similarly reinforced by short rectangular sidewalls spaced slightly from the outer sidewalls. Rimmed apertures 30A-D are formed at the corners and at positions corresponding to the posts 22A-D of the top section so that when the top section 15 mates with the bottom panel 16 the machine screws can be inserted there through. An aperture 27 is also formed in the bottom panel 16 to mount the push detent switch 25 seen in FIG. 2. The top section 15 mates with the bottom panel 16, and convenient centering is afforded by a raised lip 29 that encircles the bottom panel inwardly of the sidewalls. This lip 29 fits within the top section 15 and snaps in place, also providing the desired weather tight seal.

It should now be apparent that the structure of the housing 10 is important to its operation because once assembled the entire device 2 can fit in the palm of an adult hand, and can be easily mounted to a conventional security yard sign simply by sliding it up (stake through aperture 17) with the top section 15 facing upward until the solar lighting device 2 is spaced approximately 1 foot from the placard. The thumbscrew 17 is then tightened to clamp it on and the LED once activated will illuminate the placard. The housing 10 configuration allows the device to be manufactured most economically (two molds) and yet it is extremely rugged and weather-sealed.

The circuit board 31 is also mounted in the top section proximate the power source.

Figure 5:
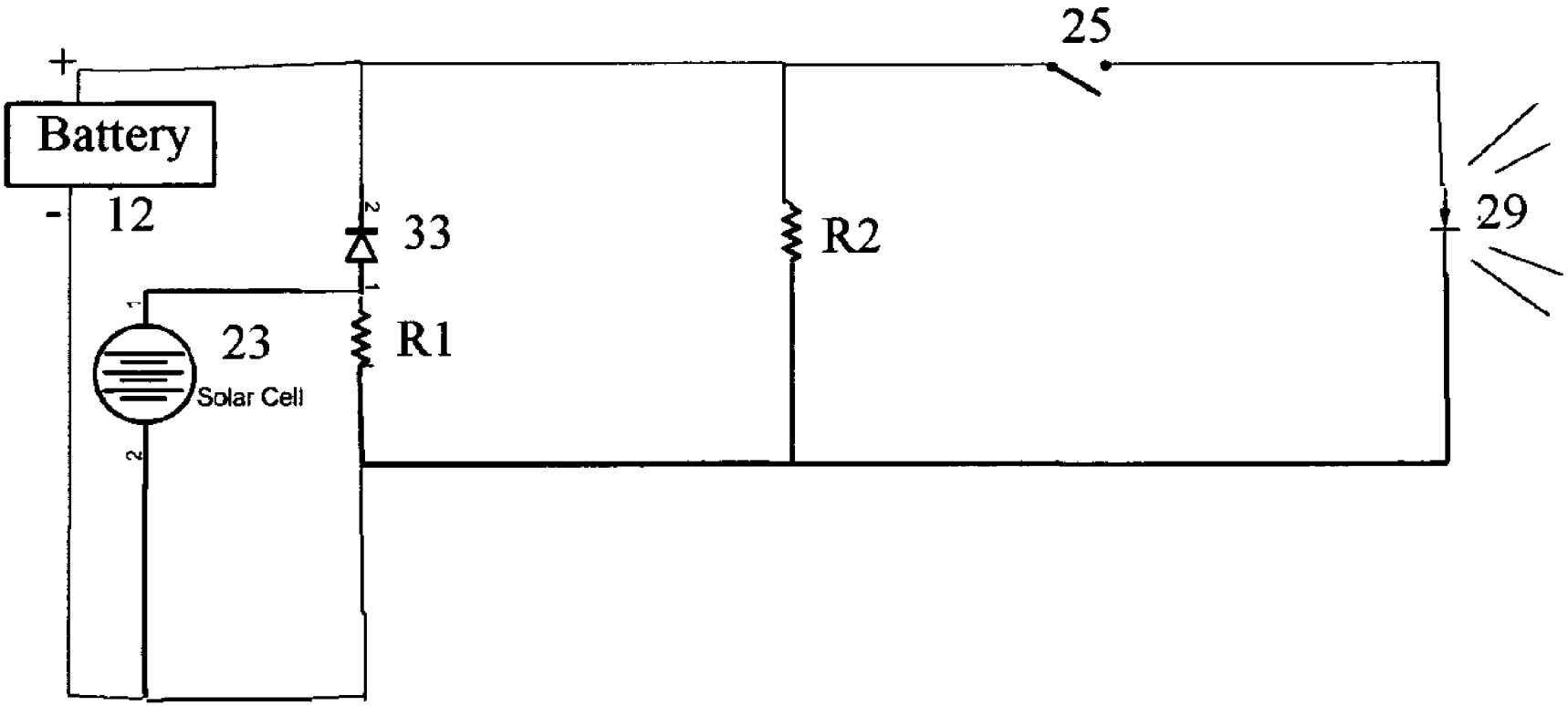
FIG. 5 is a schematic of the electrical components.

FIG. 5 is a schematic of the electrical components including those on circuit board 31.

The circuit board 31 is connected to the off-board power source which may be a conventional NiCad or Lithium Ion battery 12 as shown. The circuit board 31 contains a combined solar charging circuit, light sensor circuit, and LED driver circuit, and a variety of conventional circuits have been previously implemented for these purposes. In the illustrated embodiment, the light sensor circuit comprises a photodiode 33 connected in series with a ballast resistor R1. The solar cell 23 is connected from the battery 12 to the bridge of the photodiode 33/resistor R1. A second ballast resistor R2 is connected in parallel, and the LED (a white LED) 29 is connected in parallel through the push-detent switch 25. In operation, the photodiode 33 breaks down in the absence of ambient light and shunts the solar cell 23 to the battery 12, thereby charging the battery during the daylight. At night, the photodiode 33 remains open causing the battery 12 to drive the LED 29 directly so long as the push-detent switch 25 is closed. Of course, the push-detent switch 25 can be selectively opened to turn the LED 29 off. The net effect of the combined solar charging circuit, light sensor circuit, and LED driver circuit automatically turns the power to the LED 29 off during the day and on at night, effectively allowing the device to charge all day and illuminate all night. This allows illumination of a white LED 29 (characteristically high current drain) for approximately 12 hours between charges (a second backup battery can be included if desired). The circuits on circuit board 31 are mounted inside the top section 15 of enclosure 10.

Figure 6:
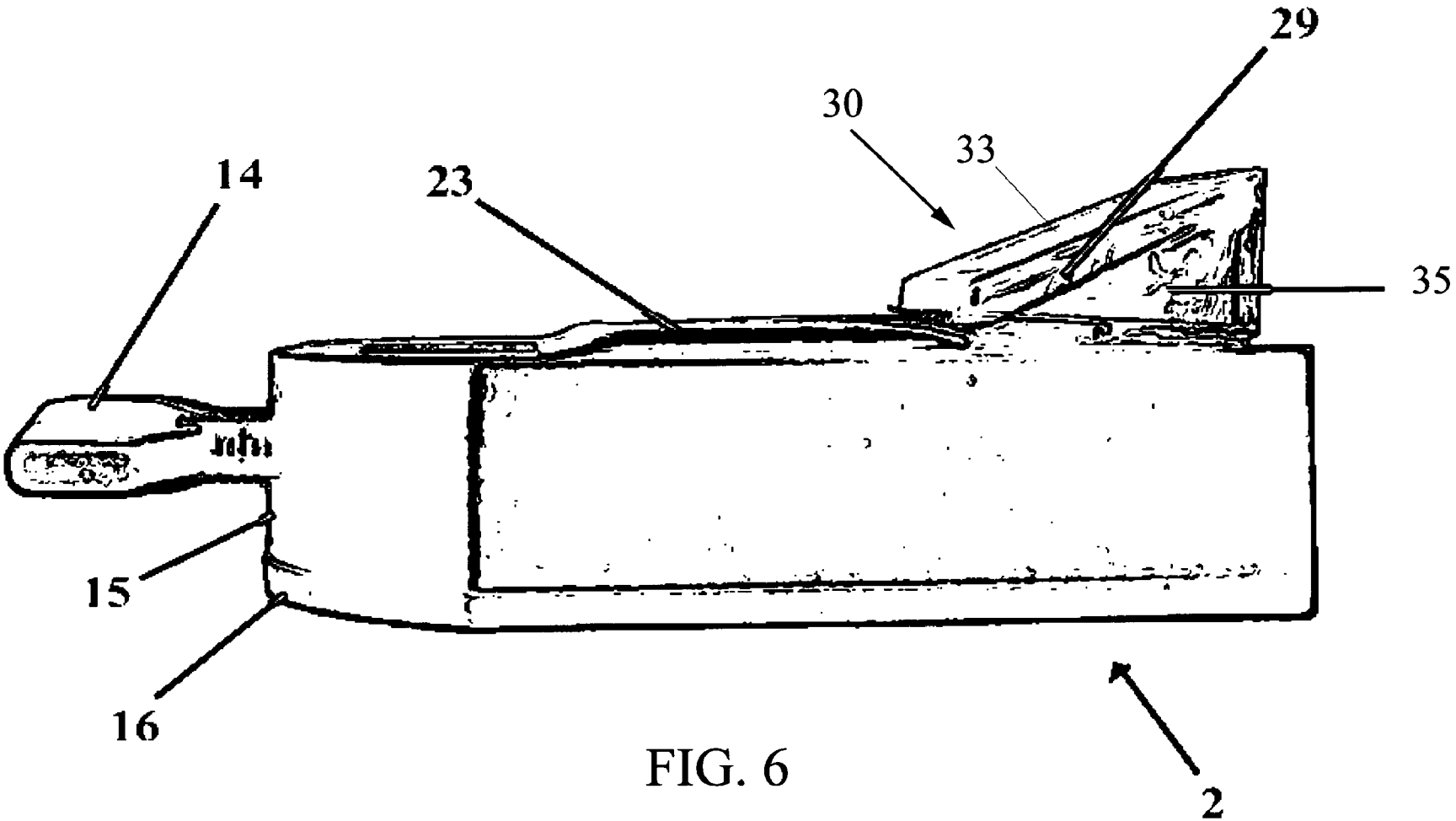
FIG. 6 is a side view of the solar light unit for home security signs 2.

FIG. 6 is a side view of the solar light unit for home security signs 2. The solar cell 23 is mounted flush atop the top section 15 of housing 10. The LED 29 is centered in an inclined a reflective assembly 30 that directs the light inward toward the security placard at approximately a 30 degree angle (counter-clockwise from horizontal). The reflective assembly 30 comprises inclined riser walls 35 that support a reflective plastic lens 33 above the LED 29. Specifically, the transparent lens 33 of the reflective assembly 30 is seated at an approximate 30 degree inwardly-inclined angle relative to the plane of the housing 10 to direct light from the LED 29 toward a centerline running through the aperture 17. It is intended by this that light from the LED 29 be directed upward (approximately one foot) and inward (approximately 3") to shine directly on the overhead security placard that is centered on the stake passing through the aperture 17. Preferably, the LED 29 is surrounded by a mirrored plastic reflecting surface (obscured) that is concave-contoured to help focus the light on the placard, and the reflecting surface may also be inclined or contoured to help direct the light as described.

As to a further discussion of the manner of usage and operation of the present device, the user should place the solar light 2 onto the security stake and tighten the thumbscrew 14 at the desired position where it brightens the placard the most.

Figure 7:
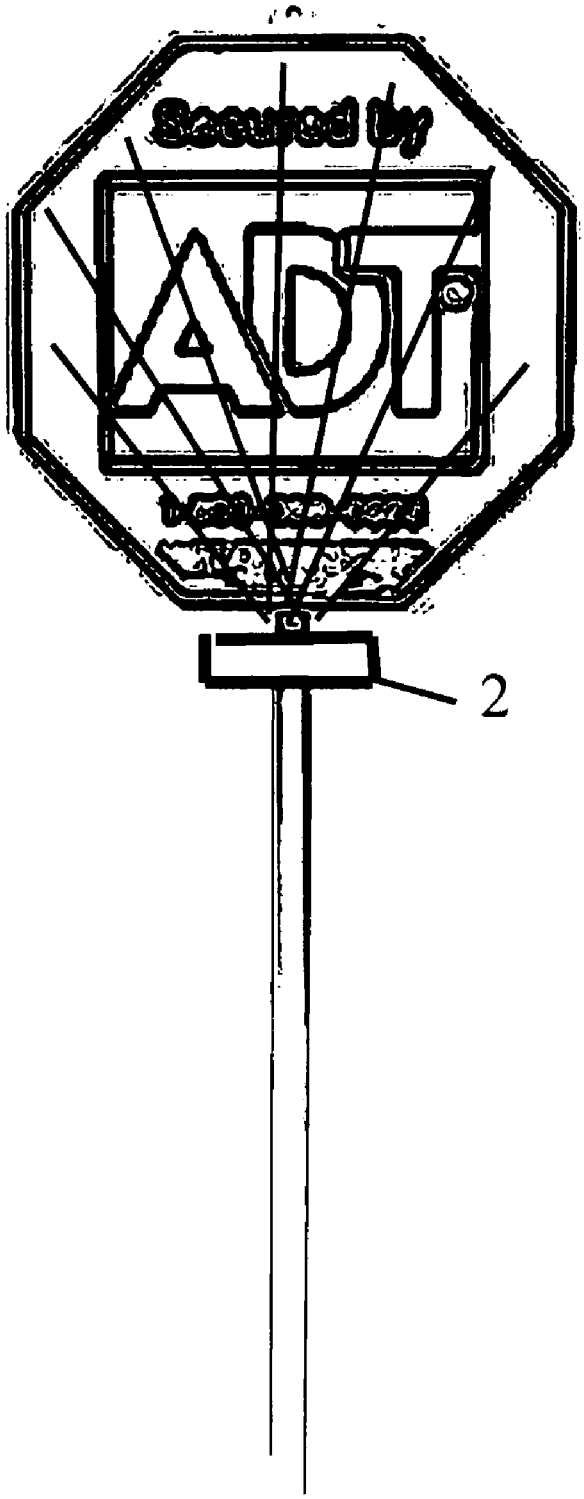
FIG. 7 is a perspective illustration of the proper positioning and operation of the device 2.

FIG. 7 is a perspective illustration of the proper positioning and operation of the device 2. It is important to leave enough space between the placard and the solar lighting device 2 so as to allow the solar cell 23 to receive direct sunlight from all directions. The security yard sign can then be implanted into the ground The user should switch on the solar light 2 by detent switch 25 to activate the "automatic on/off" mode. The device 2 is designed to work properly with enough reserved power in the rechargeable battery 12. The reserved power could be overdrawn if solar light 2 remains on during bad weather while the system is unable to recharge energy for a day or two. When weather turns sunny, the light should be turned off and let sunlight charge the system for at least 3 days before turning on the light again at night, so to fully restore the battery 12 with enough reserved power. This will ensure that the solar light device 12 works normally and maintains its brightness. To test the unit 2, after switching on the switch 25, if it is in a lighted environment simply cover the solar cell 23 so the built-in sensor will detect dusk and automatically turn on the LED 29.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present device.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. The system is robust and can support a number of different implementations. It is to be understood, therefore, that the invention may be practiced otherwise than as specifically set forth in the appended claims.

What is claimed is:

1. A solar light unit, comprising:

housing comprising a concave open-faced top panel having a top surface and a mating bottom panel having a bottom surface attached to the top panel, said top panel and said bottom panel joined at their peripheral edges by sidewalls so as to form a weatherproof enclosure, said housing having an aperture there though from said top surface to said bottom surface for receiving a stake inserted there through, and an internally threaded lateral bore intersecting said aperture from one of said sidewalls, and a thumb screw in threaded engagement with said lateral bore and rotatably advanceable so as to invade said aperture to form a clamp against said stake;

a rechargeable electrical power source seated in said housing;

a manual switch mounted on said housing;

a reflecting assembly mounted on said top surface of said top panel of said housing and comprising an LED seated in a mirrored reflecting surface and covered by a transparent lens supported at an angle relative to said top surface so as to direct light toward a centerline running through the aperture;

a solar cell mounted on said top surface of said top panel of said housing;

an internal circuit board containing a solar charging circuit, light sensor circuit, and LED driver circuit to apply power to the LED only at night when there is no ambient light, and to remove power from the LED and charge said power source during the day.

2. The solar light unit according to claim 1, wherein said aperture is characterized by a reinforcing collar extending from said top surface of said top panel to said bottom surface of said bottom panel.

3. The solar light unit according to claim 1, wherein said manual switch mounted on said housing is a push-detent switch.

4. The solar light unit according to claim 1, wherein said reflecting assembly comprises a white LED.

5. The solar light unit according to claim 1, further comprising a ground stake of a conventional yard security sign, said ground stake passing through said aperture and terminating at a placard at its upper end.

6. A solar light unit for mounting on the ground stake of a conventional yard security sign below a placard thereof, and for illuminating the placard of said security sign at night, comprising:

an enclosed housing having a top surface and a bottom surface and an aperture there through for passing the stake of said yard security sign, said aperture extending from said top surface to said bottom surface;

a thumb screw inserted into said housing substantially perpendicular to the primary axis of said aperture and invading said aperture to form a clamp against said stake;

a rechargeable battery seated in said housing;

a manual switch mounted on said housing;

a reflecting assembly mounted in said top surface of said housing and comprising an LED seated in a mirrored reflecting surface and covered by a transparent lens supported at an angle to direct light toward the placard of said security sign;

a solar cell mounted on said top surface of said housing for charging said battery;

an internal circuit board for applying power from said battery to the LED only at night when there is no ambient light, and to remove power from the LED and charge said power source during the day.

7. The solar light unit according to claim 6, wherein said enclosed housing is weatherproof.

8. The solar light unit according to claim 7, wherein said enclosed housing further comprises two mating sections including a concave open-faced top section and a mating bottom panel attached to the top section.

9. The solar light unit according to claim 8, wherein said open-faced top section is formed with risers about said aperture for reinforcement.

10. The solar light unit according to claim 6, wherein said manual switch mounted on said housing is a push-detent switch.

11. The solar light unit according to claim 6, wherein said reflecting assembly comprises a white LED.

12. The solar light unit according to claim 6, wherein the transparent lens of said reflecting assembly is mounted at an angle relative to said housing to direct light from said LED toward a centerline running through said aperture.

13. The solar light unit according to claim 12, wherein when the solar light unit is mounted on the ground stake of the conventional yard security sign the angled reflecting assembly directs light from said LED inward to shine directly on a placard of said yard security sign.

* * * * *